US012274951B1

(12) United States Patent
Cantrell

(10) Patent No.: US 12,274,951 B1
(45) Date of Patent: Apr. 15, 2025

(54) STRUCTURE, ASSEMBLY, AND METHOD FOR FORMING AND INFLATING BALLOON ARRAYS

(71) Applicant: Blake Cantrell, Ada, OK (US)

(72) Inventor: Blake Cantrell, Ada, OK (US)

( * ) Notice: Subject to any disclaimer, the term of this patent is extended or adjusted under 35 U.S.C. 154(b) by 224 days.

(21) Appl. No.: 18/118,351

(22) Filed: Mar. 7, 2023

(51) Int. Cl.
*A63H 27/10* (2006.01)

(52) U.S. Cl.
CPC ..... *A63H 27/10* (2013.01); *A63H 2027/1033* (2013.01); *A63H 2027/1083* (2013.01)

(58) Field of Classification Search
CPC ..... A63H 2027/1033; A63H 2027/1083
See application file for complete search history.

(56) References Cited

U.S. PATENT DOCUMENTS

| | | | | |
|---|---|---|---|---|
| 1,703,463 | A | 2/1929 | Weigel | |
| 3,693,266 | A | 9/1972 | Pressman | |
| 4,917,646 | A | 4/1990 | Kieves | |
| 5,127,867 | A | 7/1992 | Lau | |
| 8,789,565 | B1 * | 7/2014 | Wicken | A63H 27/10 141/237 |
| D739,474 | S | 9/2015 | Wicken | |
| 10,639,560 | B2 | 5/2020 | Mowbray | |
| D962,352 | S | 8/2022 | Davis | |
| 2008/0121309 | A1 | 5/2008 | Boise | |
| 2017/0144077 | A1 * | 5/2017 | Wicken | A63H 27/10 |
| 2017/0361239 | A1 * | 12/2017 | Malone | A63H 27/10 |

FOREIGN PATENT DOCUMENTS

| | | | | |
|---|---|---|---|---|
| CN | 203609868 | U | 5/2014 | |
| DE | 102018132341 | A1 | 6/2020 | |
| DE | 202021003709 | U1 * | 2/2022 | A63H 27/10 |
| WO | 2020156315 | A1 | 8/2020 | |
| WO | 2021012806 | A1 | 1/2021 | |

OTHER PUBLICATIONS

Translation of DE 20 2021 003 709 U1 (Year: 2021).*
https://adsco.com/products/permashine-12-balloon-cluster-kit.
https://www.balloonin.com/products/permashine-spine-manifold-4-port.
https://www.balloonin.com/products/permashine-5-port-manifold.
https://www.balloonin.com/products/6-balloon-cluster-hub.
https://lookourway.com/products/balloon-4-port-manifold.

* cited by examiner

*Primary Examiner* — Jason K Niesz
(74) *Attorney, Agent, or Firm* — Dennis D. Brown Brown Patent Law, P.L.L.C.

(57) ABSTRACT

Balloon retaining and inflating structures, assemblies, and methods which provide arrays of multiple balloons in any desired configuration, and wherein the balloons are simultaneously inflated and the array can be repeatedly inflated and deflated for re-use.

18 Claims, 4 Drawing Sheets

STRUCTURE, ASSEMBLY, AND METHOD FOR FORMING AND INFLATING BALLOON ARRAYS

FIELD OF THE INVENTION

The present invention relates to devices, assemblies, and methods for forming and inflating decorative balloon arrays, including but not limited to balloon arrays which can be repeatedly inflated and deflated.

BACKGROUND OF THE INVENTION

A need exists for an improved device, assembly, and method for forming and inflating decorative balloon arrays. The improved device, assembly, and method will preferably (a) operate to inflate all of the balloons of the array concurrently after attachment, (b) allow the balloon array to be repeatedly inflated and deflated for reuse, (c) provide for convenient transport of the balloon array in deflated form, (d) provide easy inflation of the array at the point of use, and (e) provide highly decorative balloon columns, balloon arches, balloon garlands, and other balloon figures and designs of any size.

SUMMARY OF THE INVENTION

The present invention satisfies the needs discussed above. The invention provides (a) a balloon retaining and inflating structure, (b) an assembly comprising a series of the inventive inflating structures, and (c) methods of forming and using the inventive assembly. The inflating structure and assembly will provide balloon arrays of any desired shape or configuration which (i) operate to inflate all of the balloons in the array simultaneously, (ii) can be repeatedly inflated and deflated for reuse, and (iii) can be easily transported in deflated form and conveniently inflated or reinflated at the site of use.

In one aspect, there is provided a structure for retaining and concurrently inflating a plurality of balloons which preferably comprises: (a) a ring having an opening therethrough; (b) a longitudinal axis which extends through the opening and is perpendicular to the ring; (c) a plurality of balloon attachment barbs which extend laterally outward from the ring; (d) an inflation gas channel within the ring which is in fluid communication with each of the balloon attachment barbs; and (e) an inflation gas line connection barb which extends from the ring and is in fluid communication with the inflation gas channel.

In another aspect, there is provided an assembly for retaining and concurrently inflating a plurality of balloons. The assembly preferably comprises a series of two or more balloon retaining and inflating structures in succession wherein each of the balloon retaining and inflating structures preferably comprises (i) a ring having an opening therethrough, (ii) a longitudinal axis which extends through the opening and is perpendicular to the ring, (iii) a plurality of balloon attachment barbs which extend laterally outward from the ring, (iv) an inflation gas channel within the ring which is in fluid communication with each of the balloon attachment barbs, (v) a first inflation gas line connection barb which extends from the ring and is in fluid communication with the inflation gas channel, and (vi) a second inflation gas line connection barb which extends from the ring and is in fluid communication with the inflation gas channel. In the assembly, each adjacent pair of the balloon retaining and inflating structures in the series comprises a preceding one of the balloon retaining and inflating structures followed by a succeeding one of the balloon retaining and inflating structures wherein each adjacent pair of the balloon retaining and inflating structures in the series is preferably linked together by an inflation gas connection line having (a) a first end which is connected to the first or the second inflation gas line connection barb of the preceding one of the balloon retaining and inflating structures of the adjacent pair and (b) a second end which is connected to the first or the second inflation gas line connection barb of the succeeding one of the balloon retaining and inflating structures of the adjacent pair.

Further aspects, features, and advantages of the present invention will be apparent to those in the art upon examining the accompanying drawings and upon reading the following detailed description of the preferred embodiments.

DETAILED DESCRIPTION OF THE PREFERRED EMBODIMENTS

Figure 1:
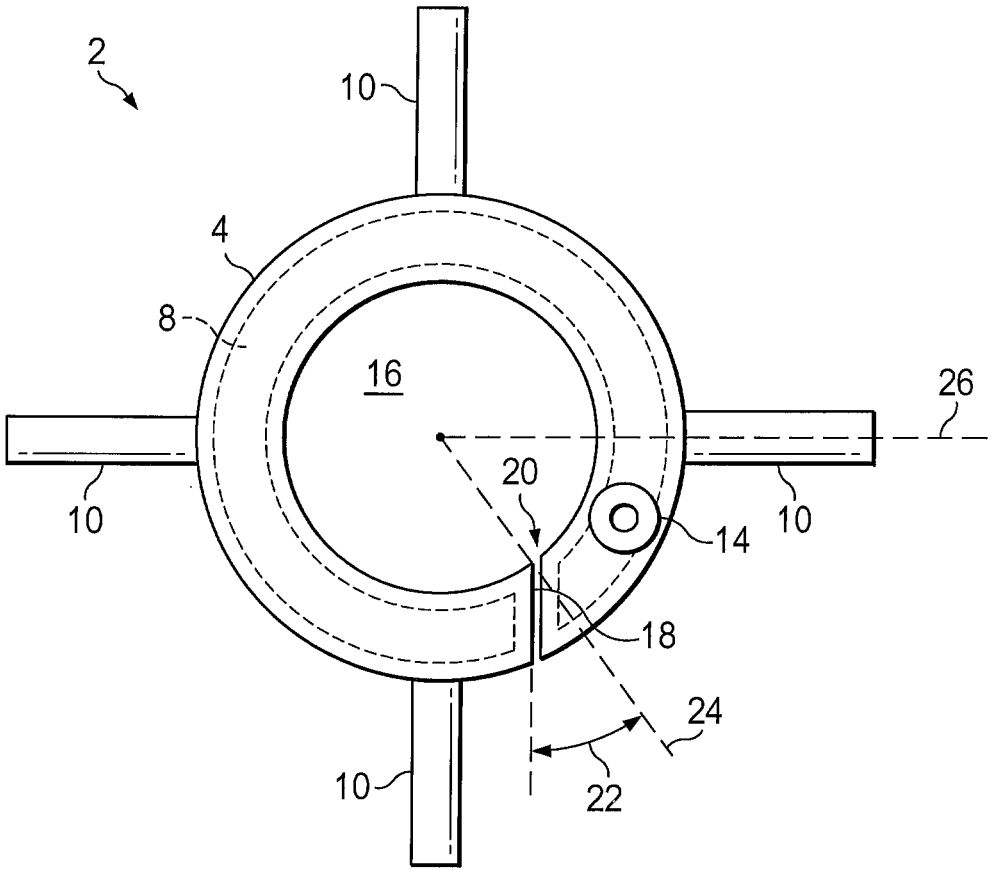
FIG. 1 is a top view of an embodiment 2 of a balloon retaining and inflating structure provided by the present invention.
Figure 2:
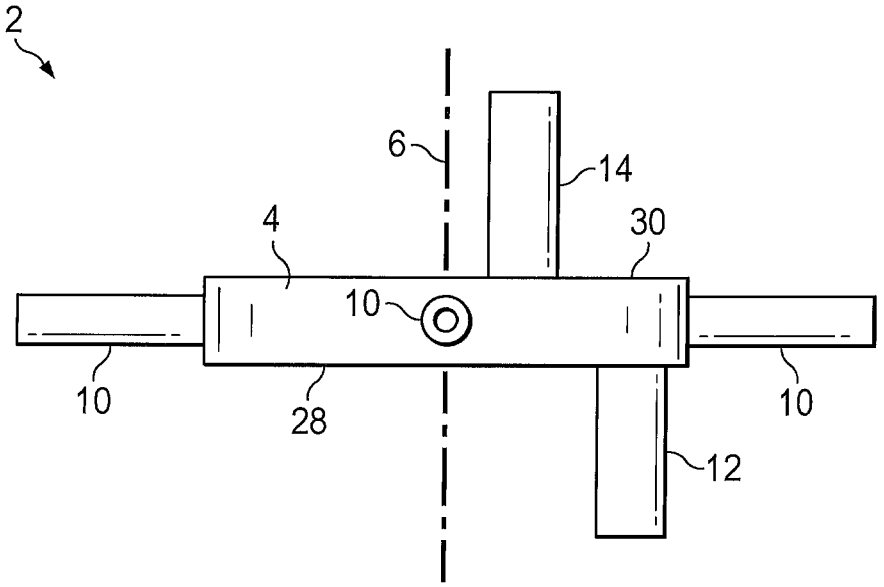
FIG. 2 is an elevational side view of the balloon retaining and inflating structure 2.
Figure 3:
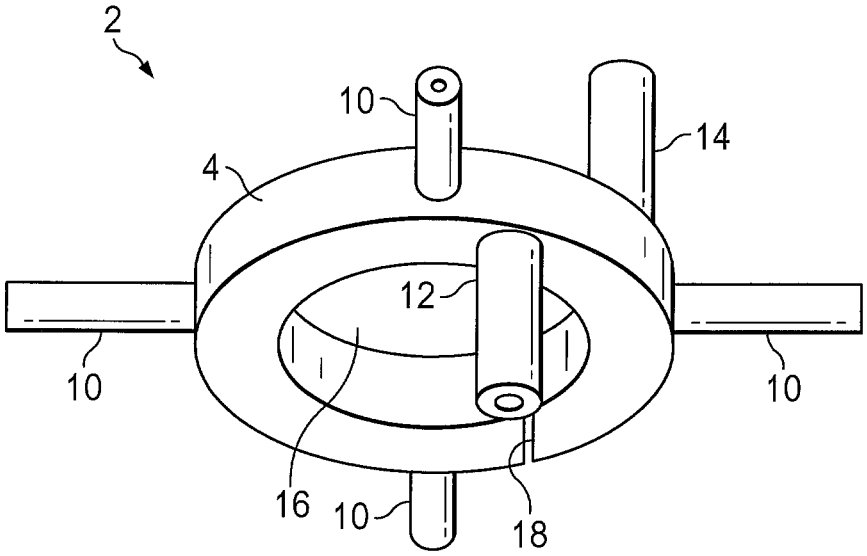
FIG. 3 is a perspective view of the balloon retaining and inflating structure 2.

An embodiment 2 of the balloon retaining and inflating structure provided by the present invention is shown in FIGS. 1-4. The inventive balloon inflating structure 2 preferably comprises: an inflation ring 4; a longitudinal axis 6; an interior inflation gas channel 8 which extends through the inflation ring 4; one or more, preferably a plurality, of balloon attachment barbs 10 which extend laterally outward from the ring 4 and are in fluid communication with the interior inflation gas channel 8; a first inflation gas line connection barb 12 which extends from the ring 4 and is in fluid communication with the interior inflation gas channel 8; and a second inflation gas line connection barb 14 which extends from the ring 4 and is also in fluid communication with the interior inflation gas channel 8.

The ring 4 of the inventive inflating structure 2 has an opening 16 therethrough. The longitudinal axis 6 extends through the opening 16 and is perpendicular to the ring 4. Preferably, depending upon whether there is an open break 18 in the ring 4, the ring 4 either surrounds or substantially surrounds (i.e., extends at least 95% around or entirely surrounds) the opening 16 and the longitudinal axis 6. The ring 4 can be circular, oval, square, rectangular, or any other desired shape.

If provided in the ring 4, the open break 18 allows a wire, string, or line to be delivered laterally through the open break 18 into the central opening 16 of the ring 4. Consequently, for example, if a series of the inventive inflating structures 2 are linked together as will be discussed below to form a decorative array, a wire, line, or string for holding or supporting the series of inflating structures 2 can be conveniently delivered laterally through the open break 18 of each inflating structure 2 in the series rather than having to thread the wire, line, or string successively through the ring openings 16 of each of the inflating structures 2 in the series.

The open break 18 in the ring 4, if present, will preferably (a) be an open slot having an inner end 20 which is in communication with (i.e., which opens into) the opening 16 of the ring 4 and (b) extend outwardly from the inner end 20 of the open slot 18 through the ring 4 at an angle 22 in the range of from 40° to 75° from a longitudinal plane 24 which contains the longitudinal axis 6 and extends through the inner end 20 of the open slot 18. The angle of the open slot 18 will prevent the inflation structure 2 from falling off of a wire, line, or string which is used for hanging one or a series of the inventive structures 2.

The inventive inflating structure 2 can have up to 10 or more balloon attachment barbs 10. The balloon attachment barbs 10 can be equally spaced or unequally spaced around the ring 4. The balloon attachment barbs 10 and the line connection barbs 12 and 14 will preferably be smooth cylindrical structures but can alternatively include one or more surrounding ridges or can be of any other shape or configuration effective for holding balloons for inflation.

The ring 4 of the inventive inflating structure 2 will preferably be circular and will preferably have just four of the balloon attachment barbs 10 which (i) are equally spaced around the inflation ring 4 and (ii) extend laterally outward along lines 26 which are perpendicular to the longitudinal axis 6.

Although other positions and orientations can alternatively be used, the first inflation gas line connection barb 12 of the inventive inflating structure 2 will preferably extend in a first longitudinal direction, spaced apart from and parallel to the longitudinal axis 6, from a first lateral face 28 of the inflation ring 4. Similarly, the second inflation gas line connection barb 14 will preferably extend in a second longitudinal direction, spaced apart from and parallel to the longitudinal axis 6, from a second lateral face 30 of the inflation ring 4. The second lateral face 30 of the inflation ring 4 is opposite the first lateral face 28 and the second longitudinal direction in which the second line connection barb 14 extends will preferably be opposite the first longitudinal direction of the first line connection barb 12. In addition, the first and the second inflation gas line connection barbs 12 and 14 will preferably be spaced apart on the arc of the inflation ring 4 so that the line connection barbs 12 and 14 are not in alignment.

Figure 4:
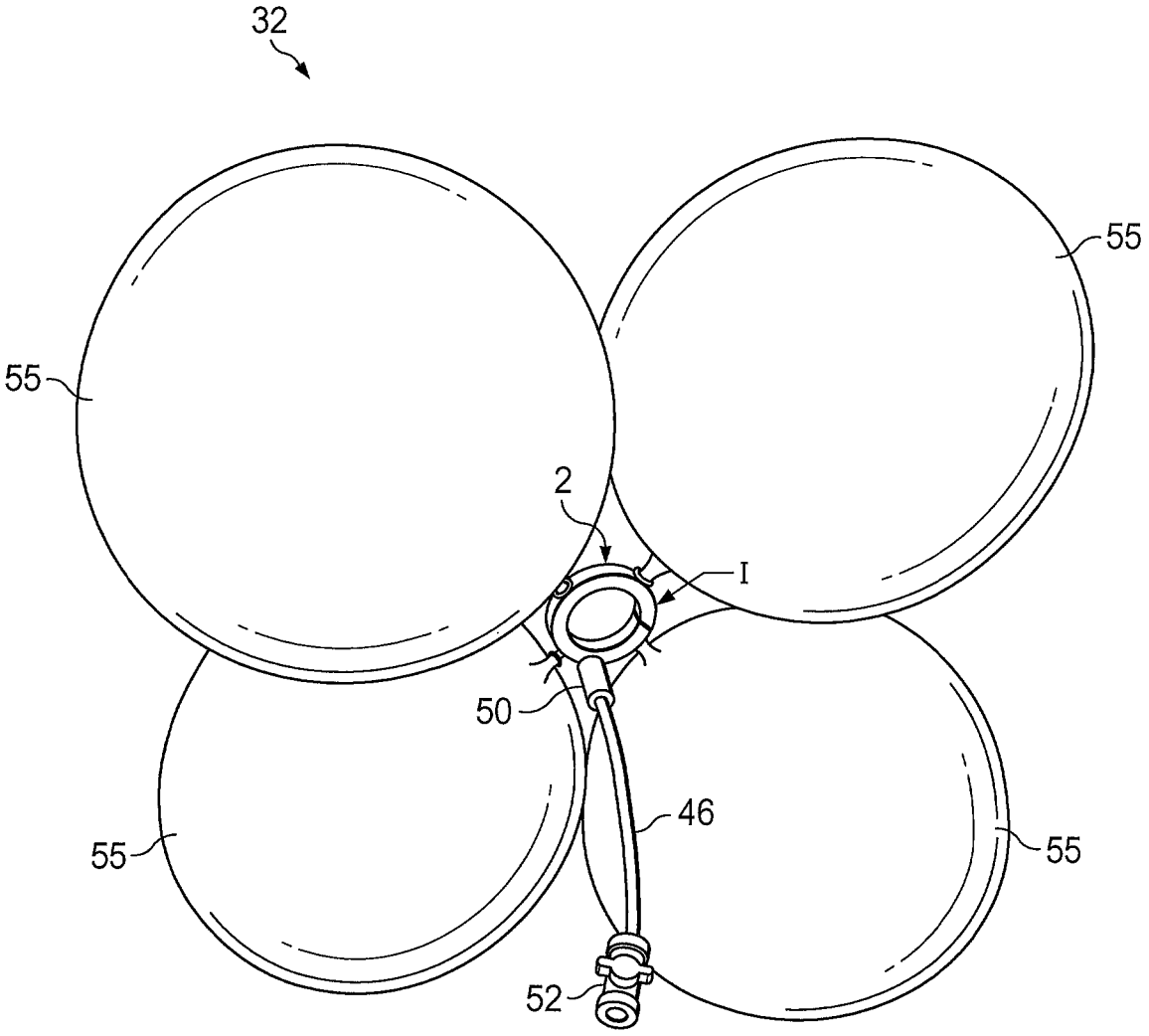
FIG. 4 is an end view of an embodiment 32 of a balloon inflation assembly provided by the present invention
Figure 5:
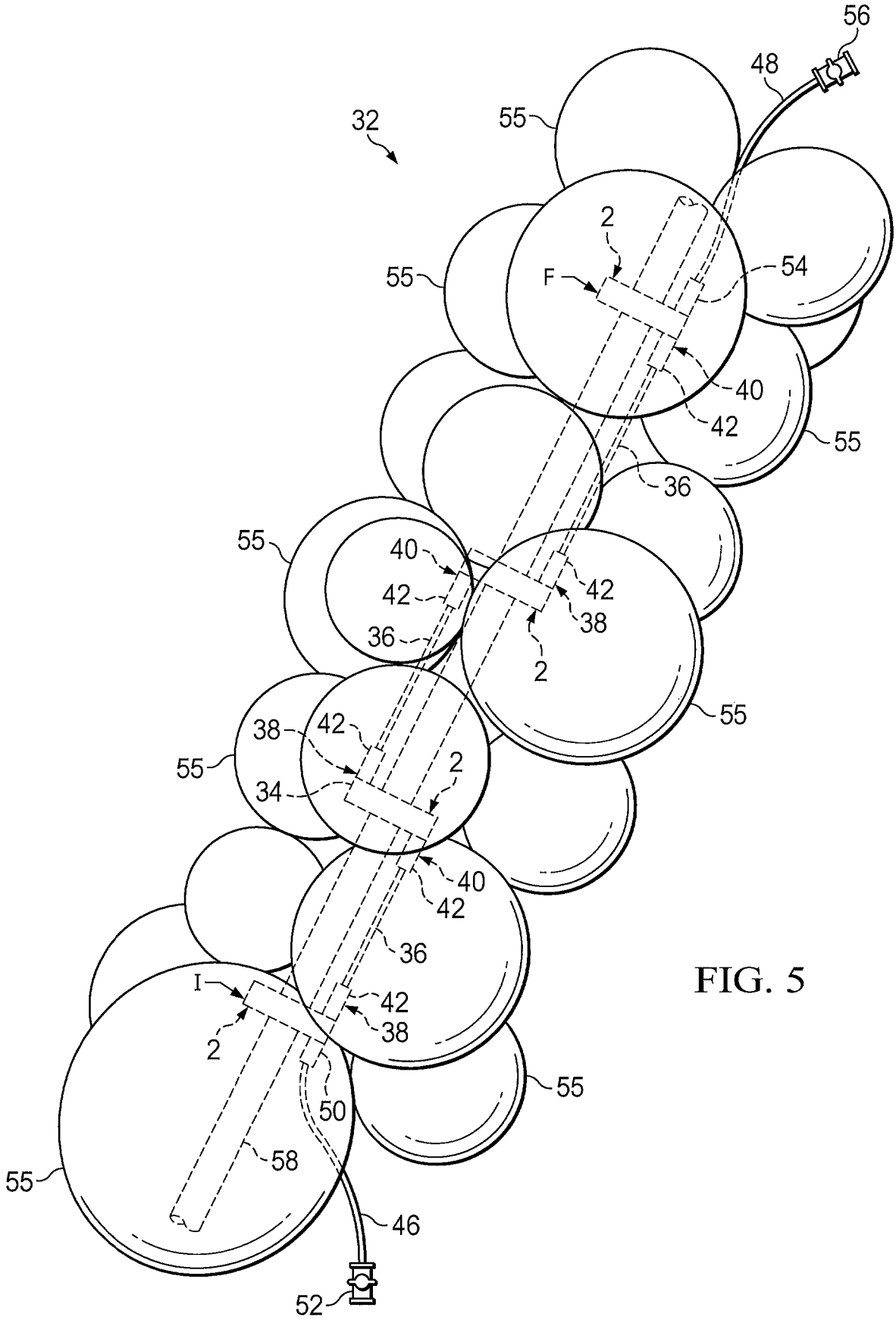
FIG. 5 is a side view of the balloon inflation assembly 32.

An embodiment 32 of the balloon inflation assembly provided by the present invention to form extended decorative arrays is illustrated in FIGS. 4 and 5. The inventive inflation assembly 32 comprises a series 34 of two or more, typically from 4 to 12, of the inventive inflating structures 2 linked together in succession. For each adjacent pair of the inflating structures 2 in the series 34, the first inventive inflating structure 2 of the pair (i.e., the preceding inflating structure 2 of the pair) is preferably linked to the second inflating structure 2 of the pair (i.e., the succeeding structure 2 of the pair) by an inflation gas connection line 36. The inflation gas connection line 36 is preferably a flexible tube or a flexible hose having (i) a first end 38 which is connected to the first or the second inflation gas line connection barb 12 or 14 of the preceding inflating structure 2 of the adjacent pair and (ii) a second end 40 which is connected to the first or the second inflation gas line connection barb 12 or 14 of the succeeding one of the balloon inflating structures 2 of the adjacent pair.

As used herein and in the claims in reference to the balloon inflating structures 2, the term "adjacent pair" means only that one of the two inflating structures 2 of the pair immediately follows the other of the two inflating structures 2 of the pair in the series 34.

Each of the inflation gas connection lines 36 preferably has a quick-connect coupling 42 on each end thereof for releasably connecting the ends 38 of the lines 36 to the line connection barbs 12 and 14 of each adjacent pair of the balloon inflating structures 2. By way of example, but not by way of limitation, the quick-connect couplings 42 can be PVC couplings with stainless steel circlips.

In the inventive assembly 32 shown in FIGS. 4 and 5, the inflating structure 2 labeled I is the initial inflating structure 2 in the series 34 and the inflating structure 2 labeled F is the final inflating structure 2 in the series 34. The initial inflating structure I has an inflation gas inlet line 46 connected to one of the line connection barbs 12 or 14 thereof, preferably the first line connection barb 12. The final inflating structure F preferably has an inflation gas discharge line 48 connected to one of the line connection barbs 12 or 14 thereof, preferably the second line connection barb 14. Each of the lines 46 and 48 preferably comprises a flexible hose or a flexible tube. Alternatively, the inflation gas discharge line 48 used on the final inflating structure F can be replaced, e.g., with a plug, a cap, or another balloon.

The inflation gas inlet line 46 preferably includes (i) a quick-connect coupling 50 of the type described above on the distal end thereof for connecting to the line connection barb 12 or 14 of the initial inflating structure I and (i) a shut off valve 52. The shut off valve 52 is preferably a quick-connect ball valve (e.g., a quick-connect union hose valve) on the proximal end of the inflation gas inlet line 46 for connecting a hose from an air compressor or other inflation gas source.

The inflation gas discharge line 48 will preferably be the same as but the reverse of the inlet line 46 (i.e., a quick-connect coupling 54 will be provided on the proximal end and the same type of shut off valve 56 will be provided on the distal end of the discharge line 48) so that, in addition to be being used to retain the inflation gas in, or discharge the inflation gas from, the inventive assembly 32, the discharge line 48 can be connected to the air compressor or other inflation gas source for filling the inventive balloon assembly 32 from the reverse direction.

The balloons 55 of the inventive inflation assembly 32 can be secured on the balloon attachment barbs 10 of the inventive inflation structures 2 using, e.g., metal gear hose clamps or other suitable clamps or devices. The balloons 55 can also be formed of any desired material of any desired thickness and can be reusable or non-reusable. Examples of suitable inflatable balloon materials include, but are not limited to, latex, PVC, and nylon.

To inflate the balloons 55 of the inventive inflation assembly 32, the shut off valve 56 of the inflation gas discharge line 48 is closed, the air compressor or other inflation gas source is connected to the inflation gas inlet line 46, the shut off valve 52 of the inlet line 46 is opened, the inflation gas is delivered into the inflation gas inlet line 46 so that the inflation gas flows through all of the inflating structures 2 of the series 34 and inflates all of the balloons 55 connected to the structures 2 concurrently, the flow of the inflation gas is then stopped, the shut off valve 52 of the inflation gas inlet line 46 is closed, and the air compressor or other inflation gas source is disconnected. To hide the inflation gas inlet and discharge lines 46 and 48 after the assembly 32 is inflated, the lines can be inserted back into the interior of the inflated assembly 32 through the central openings 16 of at least the initial and final inflating structures I and F.

It will be understood that the inflating structures 2 forming the series 34 of the inventive assembly 32 can be identical or can be different (e.g., some of the inflating structures could have more or fewer balloon attachment barbs). It will also be understood that, in order to form other shapes, one or more additional inflating structures 2 (i.e., one or more inflating structures 2 not included in the series 34) or one or more additional series of inflating structures 2 (i.e., one or more series of inflating structures 2 not included in the series 34) can be added to the inventive assembly 32 wherein, to add each additional inflating structure 2 or series of structures 2, a first end of a flexible inflation gas connection line is connected to a balloon attachment barb 10 of the added structure 2 or added series of structures 2 and a second end of the flexible inflation gas connection line is connected to one of the balloon attachment barbs 10 of one of the inflating structures 2 of the series 34.

To form a decorative garland using the inventive assembly 32, multiple lines extending, e.g., from the inflating structures 2 of the series 34, or from a wire or line running through the series 34 of inflating structures 2, can be attached to a wall, a door frame, an entry way, or any other structure at whatever points are suitable to hold the garland in the particular shape desired (e.g., the shape of the door frame). The garland will typically include at least four of the inventive inflating structures 2 linked in series and will more typically comprise a chain of from 4 to 60 of the inflating structures 2.

As illustrated in FIG. 5, other decorative shapes and structures can be formed using the inventive assembly 32 by extending a support 58 through the central openings 16 of the inflating structures 2 in the series 34 so that the inventive assembly 32 conforms to the shape of the support. If the support 58 is a straight rigid structure such as a straight pole, tube, rod, or column, the assembly 32 will take the form of a column or other linear or straight design. On the other hand, if the support 58 is a structure having a curved shape such as a curved pole, tube, or rod, then the inventive assembly 32 will take on the curved shaped (e.g., an arch, a wave signal, a letter S, etc.) of the curved support 58. When forming such straight or curved designs, the inventive assembly 32 will typically include at least four of the inventive inflating structures 2 linked in series and will more typically comprise a chain of from 4 to 60 of the inflating structures 2.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within this invention as called for in the claims.

What is claimed is:

1. A structure for retaining and concurrently inflating a plurality of balloons comprising:

a ring having an opening therethrough;

a longitudinal axis which extends through the opening and is perpendicular to the ring;

a plurality of balloon attachment barbs which extend laterally outward from the ring;

an inflation gas channel within the ring which is in fluid communication with each of the balloon attachment barbs;

a first inflation gas line connection barb which extends from the ring and is in fluid communication with the inflation gas channel; and a second inflation gas line connection barb which extends from the ring and is in fluid communication with the inflation gas channel.

2. The structure of claim 1 further comprising:

the first inflation gas line connection barb and the second inflation gas line connection barb being parallel to the longitudinal axis;

the first inflation gas line connection barb extending from the ring in a first direction; and the second inflation gas line connection barb extending from the ring in a second direction opposite the first direction.

3. The structure of claim 1 having four of the balloon attachment barbs which (i) are equally spaced around the ring and (ii) extend laterally outward along lines which are perpendicular to the longitudinal axis.

4. The structure of claim 1 further comprising the ring being circular.

5. An assembly for retaining and concurrently inflating a plurality of balloons comprising:

a series of two or more balloon retaining and inflating structures in succession, each of the balloon retaining and inflating structures comprising a ring having an opening therethrough, a longitudinal axis which extends through the opening and is perpendicular to the ring, a plurality of balloon attachment barbs which extend laterally outward from the ring, an inflation gas channel within the ring which is in fluid communication with each of the balloon attachment barbs, a first inflation gas line connection barb which extends from the ring and is in fluid communication with the inflation gas channel, and a second inflation gas line connection barb which extends from the ring and is in fluid communication with the inflation gas channel;

each adjacent pair of the balloon retaining and inflating structures in the series comprising a preceding one of the balloon retaining and inflating structures followed by a succeeding one of the balloon retaining and inflating structures; and each said adjacent pair of the balloon retaining and inflating structures in the series being linked together by an inflation gas connection line having (i) a first end which is connected to the first or the second inflation gas line connection barb of the preceding one of the balloon retaining and inflating structures of the adjacent pair and (ii) a second end which is connected to the first or the second inflation gas line connection barb of the succeeding one of the balloon retaining and inflating structures of the adjacent pair.

6. The assembly of claim 5 further comprising, for each said adjacent pair of the balloon retaining and inflating structures, the inflation gas connection line which links the adjacent pair of the balloon retaining and inflating structures together comprising a flexible hose or a flexible tube.

7. The assembly of claim 6 further comprising for each one of the balloon retaining and inflating structures:

the first inflation gas line connection barb extending from the ring in a first direction which is parallel to the longitudinal axis and the second inflation gas line connection barb extending from the ring in a second direction, opposite the first direction, which is parallel to the longitudinal axis.

8. The assembly of claim 6 further comprising:

an additional balloon retaining and inflating structure, not included in the series, which comprises a ring having an opening therethrough, a longitudinal axis which extends through the opening of the additional balloon retaining and inflating structure and is perpendicular to the ring of the additional balloon retaining and inflating structure, a plurality of balloon attachment barbs which extend laterally outward from the ring of the additional balloon retaining and inflating structure, and an inflation gas channel within the ring of the additional balloon retaining and inflating structure which is in fluid communication with each of the balloon attachment barbs of the additional balloon retaining and inflating structure and a flexible inflation gas connection line having (i) a first end connected to one of the balloon attachment barbs of one of the balloon retaining and inflating structures of the series and (ii) a second end connected to one of the balloon attachment barbs of the additional balloon retaining and inflating structure.

9. The assembly of claim 6 further comprising:

one of the balloon retaining and inflating structures in the series being an initial one of the balloon retaining and inflating structures in the series and an inflation gas inlet line having a distal end which is connected to the first or the second inflation gas line connection barb of the initial one of the balloon retaining and inflating structures.

10. The assembly of claim 8 further comprising:

one of the balloon retaining and inflating structures in the series being a final one of the balloon retaining and inflating structures in the series;

an inflation gas discharge line having a proximal end which is connected to the first or the second inflation gas line connection barb of the final one of the balloon retaining and inflating structures;

the inflation gas discharge line comprising a flexible hose or a flexible tube; and the inflation gas discharge line including a shut off valve.

11. The assembly of claim 8 further comprising the inflation gas inlet line comprising a flexible hose or a flexible tube.

12. The assembly of claim 11 further comprising the inflation gas inlet line including a shut off valve.

13. The assembly of claim 6 further comprising:

the series comprising at least four of the balloon retaining and inflating structures in succession and a support which extends through the openings of the rings of the balloon retaining and inflating structures of the series and conforms the series of the balloon retaining and inflating structures to a design shape corresponding to a shape of the support.

14. The assembly of claim 13 further comprising the support having a straight shape and the design shape of the series of the balloon retaining and inflating structures being a column.

15. The assembly of claim 13 further comprising the support having a curved shape and the design shape of the series of the balloon retaining and inflating structures being a curved design.

16. The assembly of claim 15 comprising the design shape of the series of the balloon retaining and inflating structures being an arch.

17. A structure for retaining and concurrently inflating a plurality of balloons comprising:

a ring having an opening therethrough;

a longitudinal axis which extends through the opening and is perpendicular to the ring;

a plurality of balloon attachment barbs which extend laterally outward from the ring;

an inflation gas channel within the ring which is in fluid communication with each of the balloon attachment barbs;

an inflation gas line connection barb which extends from the ring and is in fluid communication with the inflation gas channel; and the ring having an open break therein such that (i) the ring is not continuous and (ii) a wire, string, or line can be delivered laterally through the open break of the ring from outside of the ring into the opening of the ring.

18. The structure of claim 17 further comprising the open break of the ring being an open slot having an inner end in communication with the opening of the ring, the open slot extending outwardly from the inner end of the open slot through the ring at an angle in a range of from 40° to 75° from a longitudinal plane which contains the longitudinal axis and extends through the inner end of the open slot.

* * * * *